US006684530B2

(12) United States Patent
Opazo

(10) Patent No.: US 6,684,530 B2
(45) Date of Patent: Feb. 3, 2004

(54) MOISTURE AND TEMPERATURE REGULATING INSOLE

(75) Inventor: Alfonso Andrés Swett Opazo, Santiago (CL)

(73) Assignee: Asesorfas e Inversiones Santa Francisca Limitada, Santiago (CL)

( * ) Notice: Subject to any disclaimer, the term of this patent is extended or adjusted under 35 U.S.C. 154(b) by 0 days.

(21) Appl. No.: 09/766,453

(22) Filed: Jan. 19, 2001

(65) Prior Publication Data

US 2001/0022038 A1 Sep. 20, 2001

(30) Foreign Application Priority Data

Jan. 20, 2000 (CL) ..... 120-2000

(51) Int. Cl.[7] ..... A43B 7/06
(52) U.S. Cl. ..... 36/3 B; 36/44; 36/29
(58) Field of Search ..... 36/3 B, 3 R, 3 A, 36/28, 29, 35 B, 43, 44

(56) References Cited

U.S. PATENT DOCUMENTS 4,263,727 A * 4/1981 Bender et al. ..... 36/44
4,292,746 A * 10/1981 Delaney ..... 36/83
4,329,336 A * 5/1982 Su et al. ..... 424/70.17
4,461,099 A * 7/1984 Bailly ..... 36/44
4,642,912 A * 2/1987 Wildman et al. ..... 36/44
4,906,502 A * 3/1990 Rudy ..... 428/69
5,325,541 A * 7/1994 Willard ..... 2/239
5,588,226 A * 12/1996 Schenkel ..... 36/3 B
5,714,229 A * 2/1998 Ogden ..... 428/138
5,738,937 A * 4/1998 Baychar ..... 428/316.6
5,746,012 A * 5/1998 Caletti et al. ..... 36/3 B
5,753,357 A * 5/1998 Filipitsch et al. ..... 428/307.7
5,826,349 A * 10/1998 Goss ..... 36/3 R
5,845,418 A * 12/1998 Chi ..... 36/3 B
6,006,447 A * 12/1999 Neal et al. ..... 36/3 B

FOREIGN PATENT DOCUMENTS

CL 39434 4/1997

* cited by examiner

*Primary Examiner*—J. Mohandesi
(74) *Attorney, Agent, or Firm*—Michael Best & Friedrich LLP

(57) ABSTRACT

A moisture and temperature regulating insole for a shoe. The shoe includes a body having a cover and a base layer connected to the cover, and a sole having a base connected to the body and an expansive foam between the body and the base. The insole includes an absorbent layer, an elastic layer, and a closure layer. The insole is connected to the body and to the sole such that the insole absorbs the moist air within the shoe during an advance phase of the foot when the shoe is detached from the ground or floor and delivers the absorbed air with a lower content of moisture and temperature during the support phase of the foot when the shoe is supported on the ground or floor, in part to the environment and in part to the shoe body.

15 Claims, 3 Drawing Sheets

MOISTURE AND TEMPERATURE REGULATING INSOLE

FIELD OF THE INVENTION

The invention relates to shoes, and more particularly to insoles for shoes.

BACKROUND OF THE INVENTION

In the course of recent years, the shoemaking industry has developed remarkable achievements in both the quality of products that are offered to the market and the cost of these products. Reductions in the prices of these products have resulted in increased availability to almost the entire world population, including even the poorest segments.

The above mentioned progress has been obtained, in part, by making use of new, modern, and efficient industrial products that are used specifically for the manufacture of soles, uppers or dubs, insoles, and other components. Additionally, specialized designs permit the production of shoes that are designed for specific activities, such as dress, heavy-duty, safety, sport, and other types of footwear.

All such development has been focused to achieve improvements in aesthetics, health, hygiene, and comfort. Among other objectives, a main concern has been to produce a cushioning effect against a bump or blow resulting from contact with the ground or floor when the user walks, runs, or starts each step or cycle. Another objective is to utilize the kinetic energy inherent in the act of being supported on the ground or floor when walking or running, so as to partially return the energy to the user when the foot is lifted or detached from the ground or floor.

SUMMARY OF THE INVENTION

While attention has been directed to the development in other areas, progress with respect to foot temperature and moisture regulation has been limited to improving the permeability of the shoe, so as to enhance the escape of perspiration from the shoe. The present invention is directed to a moisture and temperature regulating insole for use within a shoe. The shoe adapts itself to the individual requirements of each user that are dependent upon factors such as the level of activity performed by the user, the weight of the user, and the ambient temperature and humidity.

The present invention is intended to produce an insole to be incorporated in a shoe such that the insole maintains an ideal temperature and moisture content within the shoe, but which maintains these ideal conditions when the user's activities change or the environmental conditions change. For example walking versus running, cold versus warm weather, or humid versus dry conditions.

The object of this invention is highly important because the foot is the part of the body which generates the greatest amount of moisture. The average amount of perspiration for a pair of feet is approximately 250 cc/day. This perspiration originates from approximately 60,000 sweat glands, of which 80% are located in the soles of the feet.

Under normal conditions, the temperature of a foot inside of a shoe reaches 40 to 50° C., and may rise considerably if a temperature regulated shoe, as proposed by the present invention, is not used.

The poorly managed moisture conditions within the shoe causes fungi growth, foot itching, foot odor, and other foot health and hygiene problems.

The present invention solves a highly complex problem, because everybody generates a different amount of moisture and a different temperature. These personal characteristics vary according to different variables such as gender, age, weight, and time of day.

DETAILED DESCRIPTION OF THE INVENTION

Figure 2:
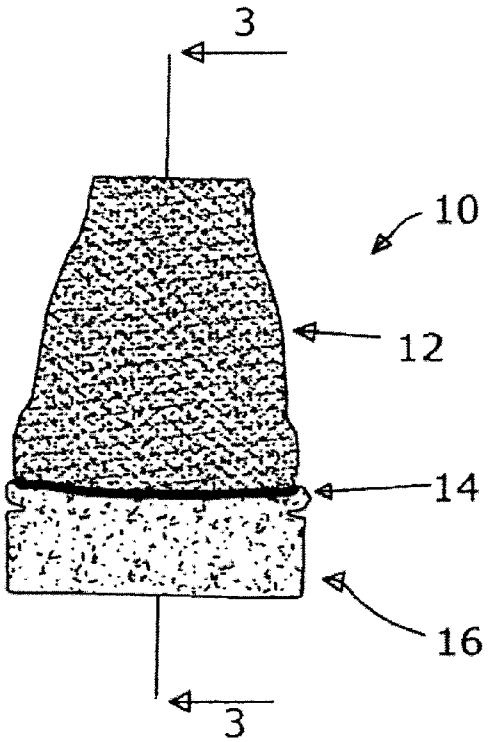
FIG. 2 is a front view of the shoe illustrated in FIG. 1.
Figure 1:
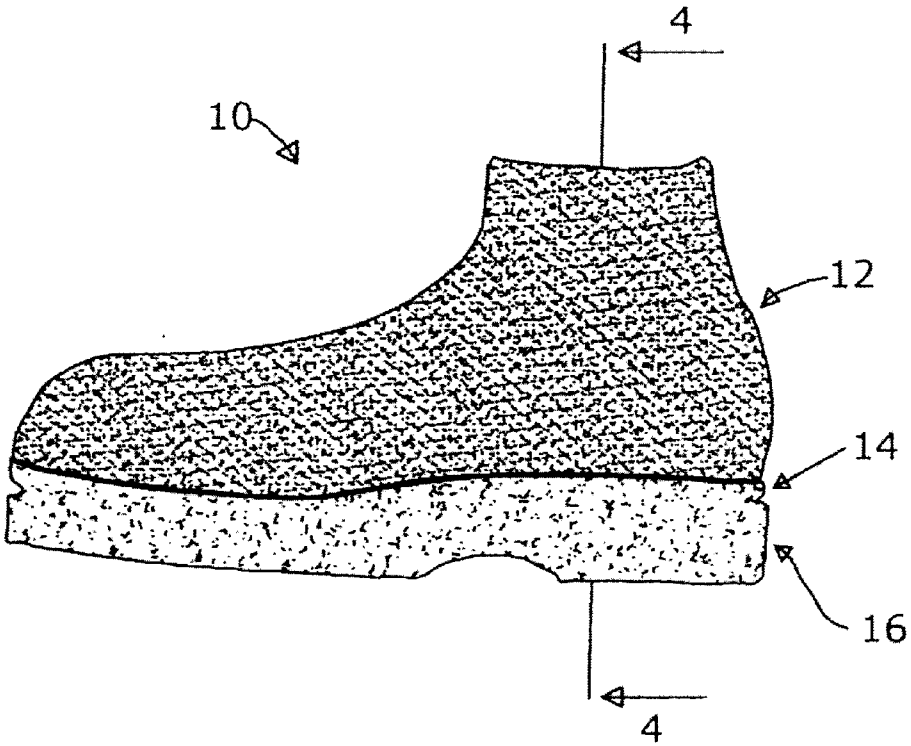
FIG. 1 is a side view of a shoe that includes a regulating insole of the present invention.
Figure 3:
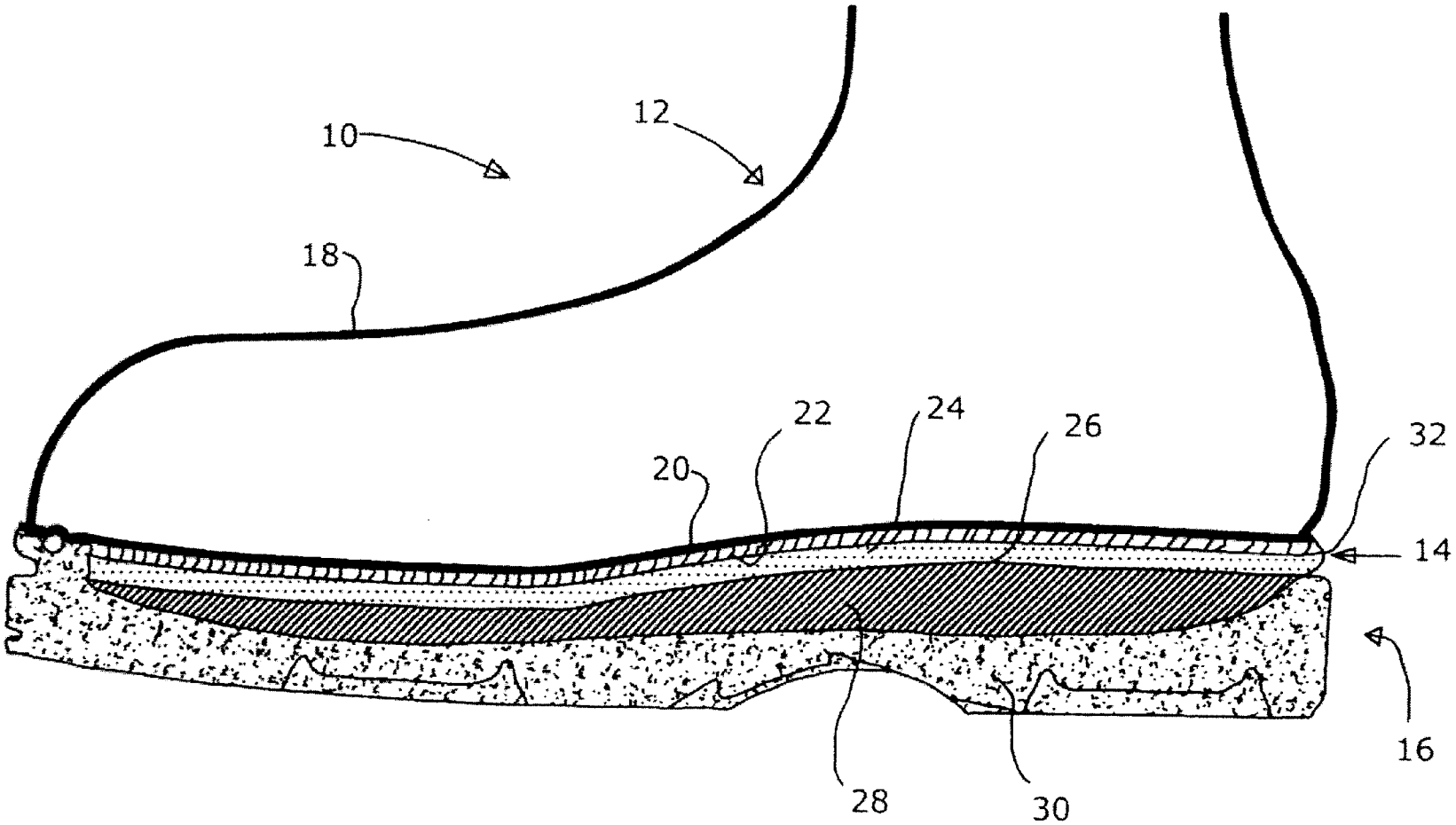
FIG. 3 is a section view taken along line 3—3 in FIG. 2.

The drawings illustrate a shoe 10 embodying the invention. The properties of the shoe 10 derive from the coordinated and simultaneous operation of three shoe components (see FIGS. 1–3), namely the body 12, the regulating insole 14, and the sole 16.

The shoe body 12 includes a cover 18 and a base layer 20 that is preferably an anti-mycotic perforated leather which serves as the foot supporting base and performs the following functions: (i) to fix the shoe 10 to the foot in a comfortable and hygienic manner, (ii) to transmit the user mechanical efforts in part to the regulating insole 14 and in part to the sole 16 during the advance phase of the foot when walking or running, (iii) to receive the regulating insole 14 and the sole 16 mechanical response during the foot support phase on the ground or floor and to transmit it to the user, for utilization in the next advance phase, and (iv) to permit the perspiration pass, principally into the regulating insole 14 and secondarily into the environment through the cover 18.

The regulating insole 14 is located between the body 12 and the sole 16 and includes an absorbent layer 22, an elastic, resilient layer 24 and a closure layer 26, whose functions are as follows: (i) to receive the mechanical efforts transmitted by the body 12 and use same in its convenient deformation, thus fulfilling its expansion cycle and delivering the energy surplus to the sole 16, (ii) to receive the sole 16 mechanical response in the foot support phase on the ground or floor and use it in its deformation, thus fulfilling the compression cycle thereof and delivering the energy surplus to the shoe body 12, (iii) to receive perspiration from within the shoe 10 and discharge it into the environment, except for part of the perspiration gaseous phase which is delivered to the sole 16.

The sole 16 is located under the regulating insole 14 and includes expansive foam 28 and a base 30. The sole 16 functions as follows: (i) to receive the mechanical efforts originating in part in the body 12 and in part in the regulating insole 14 and use them for lifting or detaching the shoe 10 from the ground/floor during the advance phase, (ii) to receive the ground/floor mechanical response in the shoe 10 support phase on the ground/floor, (iii) to accumulate part of the energy received in the form of deformation and internal energy, in order to dampen the bumps inherent in each step, (iv) to transform the remaining energy received during the shoe 10 and user's movement, using the ground/floor as a support, (v) to deliver the energy accumulated in the shoe 10 support phase over the ground or floor to the body 12 and the regulating insole 14 upon commencement of the advance phase, i.e. when the shoe 10 is detached from the ground/floor for utilization thereof by the user in his/her displacement, and (vi) to receive part of the gases which form part of the perspiration, as mentioned above and to discharge them to the outside by means of a similar chain of the pressure changes already described for the insole 14.

In order to analyze the function of the invention, we have divided each cycle of the act of walking or running into two phases, namely the "advance" and "support" phases, which are separately applied to each of the feet.

We have defined the advance phase in respect of each foot starting at the instant when, being supported on the ground or floor, the foot starts to be detached therefrom and ends at the instant when the shoe 10 again touches the ground or floor.

The support phase commences in turn upon completion of the preceding advance phase and ends upon the start of the next cycle with its own advance phase; in other words, it covers the whole process of weight discharge from the user's body on the heel and the subsequent transfer thereof from the heel to the front part of the foot.

At the beginning of the advance phase, the heel zone of the regulating insole 14 undergoes expansion and increases its volume, since the load of the heel has been just alleviated. On the other hand, the regulating insole 14 in the shoe 10 front part begins expansion the instant the foot is lifted and begins detaching the shoe 10 from the ground or floor.

The plastic industry offers mono-filament type membranes that provides the mechanical properties required by the elastic layer 24 of the regulating insole 14.

This expansion process results in a drop of the regulating insole 14 total pressure, which facilitates the entry of air into the shoe 10, and charges the regulation insole with perspiration through the holes of the base layer 20. At the same time, entry of air from the outside occurs although in a smaller amount by an edge 32 of the regulating insole 14, which is especially designed to this effect.

In this expansion phase the sole 16 will receive part of the perspiration gases, as described in above, which will be discharged to the outside in the next support phase.

The present invention joins the shoe body 12, the regulating insole 14, and the sole 16 such that a typical flange of the sole is eliminated from the joint permitting the above mentioned air flow. This special type of seam eliminates the typical sole 16 flange and permits holes located all around the complete insole 14 perimeter to evacuate gases from the shoe 10.

Both air currents enter into the elastic layer 24, which is capable of being expanded and compressed in each cycle, thus reducing the water partial pressure and the temperature within the shoe body 12, which is perspiration-loaded.

The hydrophilic absorbent layer 22 is in direct contact with the elastic layer 24 of the insole 14 and it also absorbs the perspiration transported by the air current originating from within the shoe 10.

The present invention uses modern membranes having the properties required by the absorbent layer 22. They have a polymer made up by one long chain of bound atoms of carbon, hydrogen and oxygen which, by way of response to the positive and negative charges, will absorb the moisture. It is possible to use some products available in the market such as GOROTEX, SIMPLATEX, EPTFD or TEPOR.

The closure layer 26 separates the sole 16 from the regulating insole 14. The closure layer 26 prevents the transfer of liquids, but allows the transfer of gases between the elastic layer and the expansive foam. There are several types of fabrics or webs known in the art which are capable of thoroughly performing this function.

Upon completion of the advance phase, the resilient, elastic layer 24 is completely expanded and filled with humid air under full pressure. The elastic layer's partial water pressure and temperature are slightly lower than the partial water pressure and atmospheric temperature within the shoe 10. The absorbent layer 22 is in its greatest water content phase, which is absorbed by the elastic layer 24.

The sole 16 to which the invented insole 14 is fixed consists of expansive foam 28 and the base 30. The sole is designed to receive the user's mechanical efforts and apply them to detach the shoe 10 from the ground or floor, to receive the ground/floor mechanical response, to absorb the bumps of each step, to transform the surplus energy received when in movement using the ground/floor as a support and next return the energy accumulated in the shock absorption for utilization by the user in his/her displacement, and to deform the elastic layer 24 of the regulating insole 14, which is necessary for its correct operation.

Figure 5:
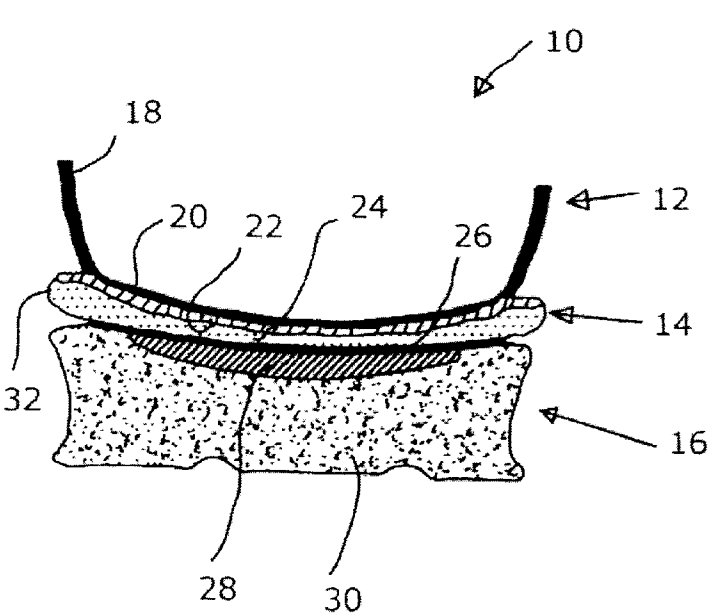
FIG. 5 is a view similar to FIG. 4, illustrating the regulating insole in a support phase.
Figure 4:
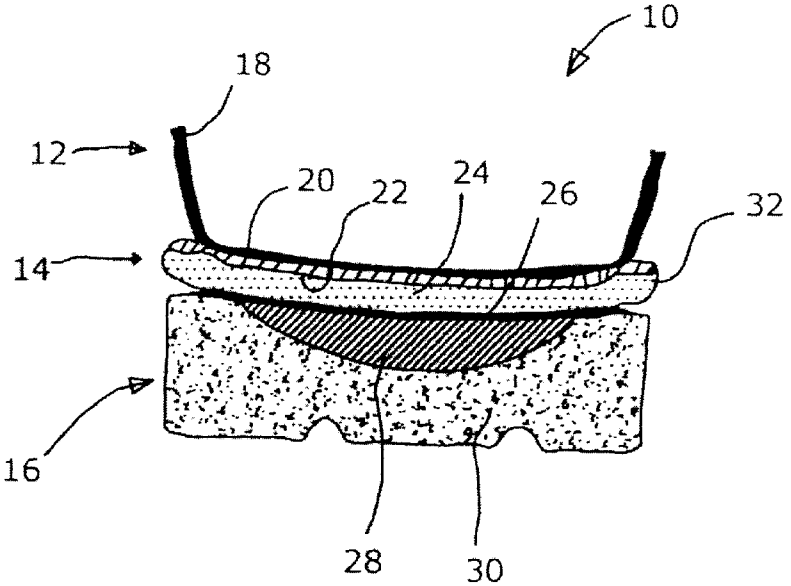
FIG. 4 is a section view taken along line 4—4 in FIG. 1, illustrating the regulating insole in an advance phase.

The sole 16 design forming part of this invention produces a gradual compression and collapse of the regulating insole 14 elastic layer 24 and of the expansive foam 28 during the support phase of each foot, which starts in the longitudinal central axis of the insole 14 (see FIGS. 4 and 5) and is transversally propagated toward the shoe 10 edge, perpendicularly to said axis. Said deformation commences in the heel zone and is then repeated in parallel sections which are perpendicular to the longitudinal central axis The deformation starts closer to the heel and ends more distant, as the weight of the user's body is transferred from the heel to the toes.

The above described deformations result in the expulsion of the perspiration contained in the elastic layer 24 of the regulating insole 14 and the expansive foam 28, i.e. a "peristaltic" effect through its edge 32.

We claim:

1. A moisture and temperature regulating insole for a shoe, the shoe including a body having a cover and a base layer connected to the cover, and a sole having a base connected to the body and an expansive foam between the body and the base, the insole comprising:

an absorbent layer adjacent the base layer;

an elastic layer adjacent the absorbent layer wherein the elastic layer includes an edge contacting the outside environment, the elastic layer being fluidly connected to the outside environment through the edge; and a closure layer adjacent the elastic layer and the sole, wherein the insole is connected to the body and to the sole such that the insole absorbs the moist air within the shoe during an advance phase of the foot when the shoe is detached from the ground or floor and delivers the absorbed air with a lower content of moisture and temperature during the support phase of the foot when the shoe is supported on the ground or floor, in part to the environment through the edge and in part to the shoe body.

2. The insole of claim 1, wherein the elastic layer is expandable to admit the entry of a fluid, the elastic layer being fluidly connected to the inside of the body through small holes perforated in the base layer.

3. The insole of claim 1, wherein the support phase causes a peristaltic type deformation in the elastic layer of the insole that compresses the elastic layer, the compression commencing in the center of the insole and advancing to a periphery of the shoe, perpendicularly to a main axis of the shoe, as the foot discharges its entire weight over the sole.

4. The insole of claim 1, wherein the absorbent layer absorbs part of the air moisture within the body during the advance phase and delivers this air moisture to the insole during the support phase, thereby contributing to the dehumidification of the shoe.

5. The insole of claim 1, wherein the closure layer prevents the contact of liquids existing in the insole with the sole.

6. The insole of claim 1, wherein the base layer separates the body and the insole and the base layer is a perforated anti-mycotic leather.

7. The insole of claim 1, wherein the elastic layer is a membrane made of mono-filament.

8. The insole of claim 1, wherein the expansive foam is an expanded polyurethane.

9. The insole of claim 1, wherein the absorbing layer is a membrane made of a polymer consisting of a long chain of bound atoms of carbon, hydrogen and oxygen that permits the absorption and release of moisture in response to positive and negative charges.

10. The insole of claim 1, wherein the insole is connected between the cover and the sole by a seam to form a union between the sole and the cover to maximize the contact and interchange between the insole of the shoe and the external environment.

11. A shoe comprising:

a body having a cover and a base layer connected to the cover, the base layer used to support a foot;

a sole having a base connected to the body and an expansive foam between the body and the base; and an insole between the body and the sole, the insole including an absorbent layer; an elastic layer, and a closure layer, wherein the elastic layer includes an edge contacting the outside environment, the elastic layer being fluidly connected to the outside environment through the edge, and wherein the insole absorbs the moist air within the shoe during an advance phase of the foot when the shoe is detached from the ground or floor and delivers the absorbed air with a lower content of moisture and temperature during the support phase of the foot when the shoe is supported on the ground or floor, in part to the environment through the edge and in part to the shoe body.

12. A moisture and temperature regulating insole for a shoe, the shoe including a body having a cover and a base layer connected to the cover, and a sole having a base connected to the body and an expansive foam between the body and the base, the insole comprising:

an absorbent layer adjacent the base layer;

an elastic layer adjacent the absorbent layer; and a closure layer adjacent the elastic layer and the sole, wherein the closure layer prevents the contact of liquids existing in the insole with the sole, and wherein the insole is connected to the body and to the sole such that the insole absorbs the moist air within the shoe during an advance phase of the foot when the shoe is detached from the ground or floor and delivers the absorbed air with a lower content of moisture and temperature during the support phase of the foot when the shoe is supported on the ground or floor, in part to the environment and in part to the shoe body.

13. A moisture and temperature regulating insole for a shoe, the shoe including a body having a cover and a base layer connected to the cover, and a sole having a base connected to the body and an expansive foam between the body and the base, the insole comprising:

an absorbent layer adjacent the base layer;

an elastic layer adjacent the absorbent layer; and a closure layer adjacent the elastic layer and the sole, wherein the base layer separates the body and the insole, and wherein the insole is connected to the body and to the sole such that the insole absorbs the moist air within the shoe during an advance phase of the foot when the shoe is detached from the ground or floor and delivers the absorbed air with a lower content of moisture and temperature during the support phase of the foot when the shoe is supported on the ground or floor, in part to the environment and in part to the shoe body.

14. A shoe comprising:

a body having a cover and a base layer connected to the cover, the base layer used to support a foot;

a sole having a base connected to the body and an expansive foam between the body and the base; and an insole between the body and the sole, the insole including an absorbent layer; an elastic layer, and a closure layer, wherein the insole absorbs the moist air within the shoe during an advance phase of the foot when the shoe is detached from the ground or floor and delivers the absorbed air with a lower content of moisture and temperature during the support phase of the foot when the shoe is supported on the ground or floor, in part to the environment and in part to the shoe body, and wherein the closure layer prevents the contact of liquids existing in the insole with the sole.

15. A shoe comprising:

a body having a cover and a base layer connected to the cover, the base layer used to support a foot;

a sole having a base connected to the body and an expansive foam between the body and the base; and an insole between the body and the sole, the insole including an absorbent layer; an elastic layer, and a closure layer, wherein the base layer separates the body and the insole, and wherein the insole absorbs the moist air within the shoe during an advance phase of the foot when the shoe is detached from the ground or floor and delivers the absorbed air with a lower content of moisture and temperature during the support phase of the foot when the shoe is supported on the ground or floor, in part to the environment and in part to the shoe body.

* * * * *

UNITED STATES PATENT AND TRADEMARK OFFICE

CERTIFICATE OF CORRECTION

PATENT NO. : 6,684,530 B2
DATED : February 3, 2004
INVENTOR(S) : Alfonso Andres Swett Opazo It is certified that error appears in the above-identified patent and that said Letters Patent is hereby corrected as shown below:

Title page,
Item [73], Assignee, should read: -- Asesorías e Inversiones Santa Francisca Limitada --

Signed and Sealed this

Twenty-second Day of June, 2004

JON W. DUDAS
*Acting Director of the United States Patent and Trademark Office*